US006681664B1

(12) United States Patent
Hsien

(10) Patent No.: US 6,681,664 B1
(45) Date of Patent: Jan. 27, 2004

(54) HANDLE FOR HAND TOOL

(76) Inventor: Chih-Ching Hsien, No. 367, Pei Yang Rd., Feng Yuan, Taichung (TW)

( * ) Notice: Subject to any disclaimer, the term of this patent is extended or adjusted under 35 U.S.C. 154(b) by 0 days.

(21) Appl. No.: 10/193,118

(22) Filed: Jul. 12, 2002

(51) Int. Cl.[7] ..... B25G 1/01
(52) U.S. Cl. ..... 81/489; 81/177.1; 81/177.3; 30/340
(58) Field of Search ..... 81/489, 177.1, 81/177.3; 30/340, 164.5

(56) References Cited

U.S. PATENT DOCUMENTS 4,739,536 A * 4/1988 Bandera et al. ..... 16/430
4,922,575 A * 5/1990 Riemann ..... 16/430
5,228,363 A * 7/1993 Corona et al. ..... 81/439
5,722,116 A * 3/1998 Lin ..... 16/436
D398,507 S * 9/1998 Thompson et al. ..... D8/83
5,823,078 A * 10/1998 Liu ..... 81/436
6,029,549 A * 2/2000 Baker ..... 81/439
6,314,617 B1 * 11/2001 Hastings ..... 16/436

* cited by examiner

*Primary Examiner*—George Nguyen
*Assistant Examiner*—Alvin J Grant
(74) *Attorney, Agent, or Firm*—Rosenberg, Klein & Lee

(57) ABSTRACT

A hand tool includes a handle and a shank extending from a first end of the handle. A plurality of recesses are defined in an outer surface of the handle and located close to the first end of the handle so that the thumb of the user may be placed in one of the recesses. A plurality of ridges extend from the outside of the handle.

4 Claims, 5 Drawing Sheets

HANDLE FOR HAND TOOL

FIELD OF THE INVENTION

The present invention relates to a handle of a hand tool and the handle has a plurality of recesses for receiving the thumb of the hand and a plurality of ridges extending from the surface of the handle so as to increase the friction.

BACKGROUND OF THE INVENTION

A conventional hand tool is shown in FIG. 1 and generally includes handle 10 and a shank 11 extending from the handle 10. The handle 10 is suitable for being held by hand of the user and generally is a tubular bar. The handle 10 has a smooth surface and is not convenient for the user to hold the handle 10 tightly. When rotating the hand tool, the friction between the handle 10 and the hand of the user is critical for output a torque. "When the handle 10, or the hand contains grease or sweat the handle tends to be slippery".

The present invention intends to provide a handle of a hand tool wherein the handle has recesses for the thumb to be rested such that the handle is more securely held by the hand and the friction between the handle and the hand is high enough to facilitate the output a high torque.

SUMMARY OF THE INVENTION

In accordance with one aspect of the present invention, there is provided a hand tool which comprises a handle with a shank extending from a first end of the handle. A plurality of recesses are defined in an outer surface of the handle and located close to the first end of the handle.

The primary object of the present invention is to provide a handle of a hand tool wherein the handle is able to be securely held by the user.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
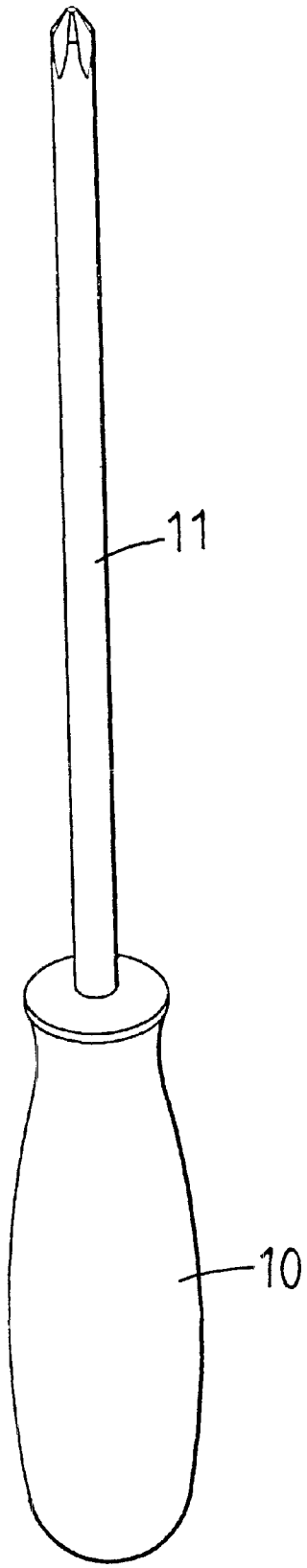
FIG. 1 is a perspective view to show the conventional hand tool.
Figure 2:
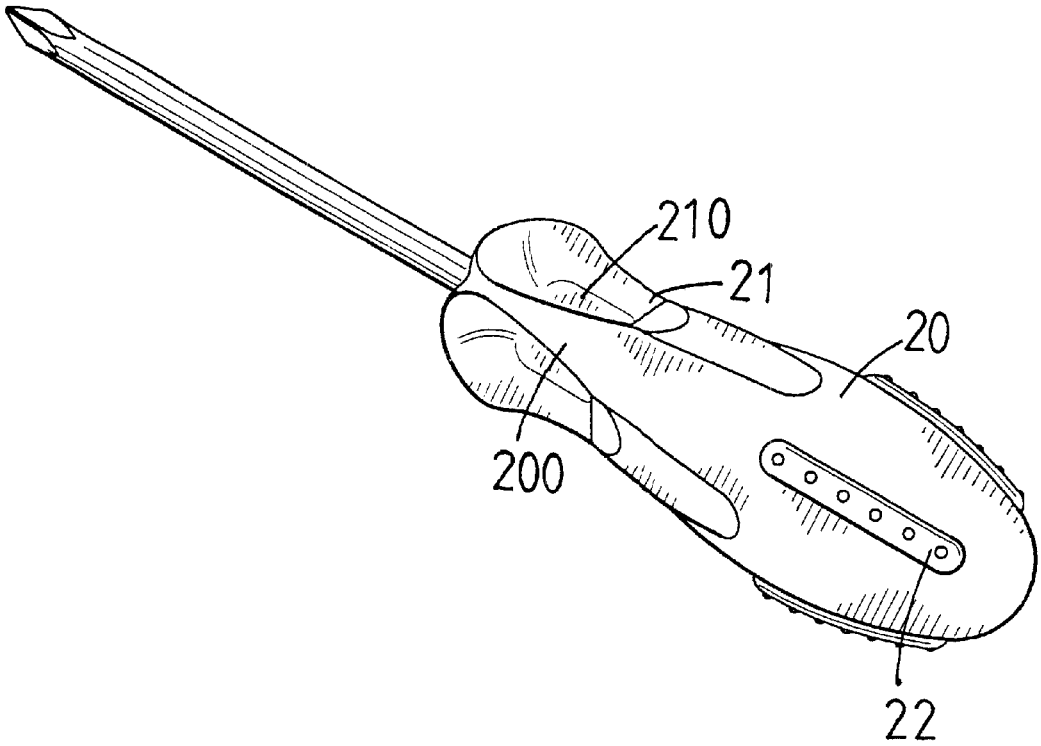
FIG. 2 is a perspective view to show the hand tool of the present invention.
Figure 3:
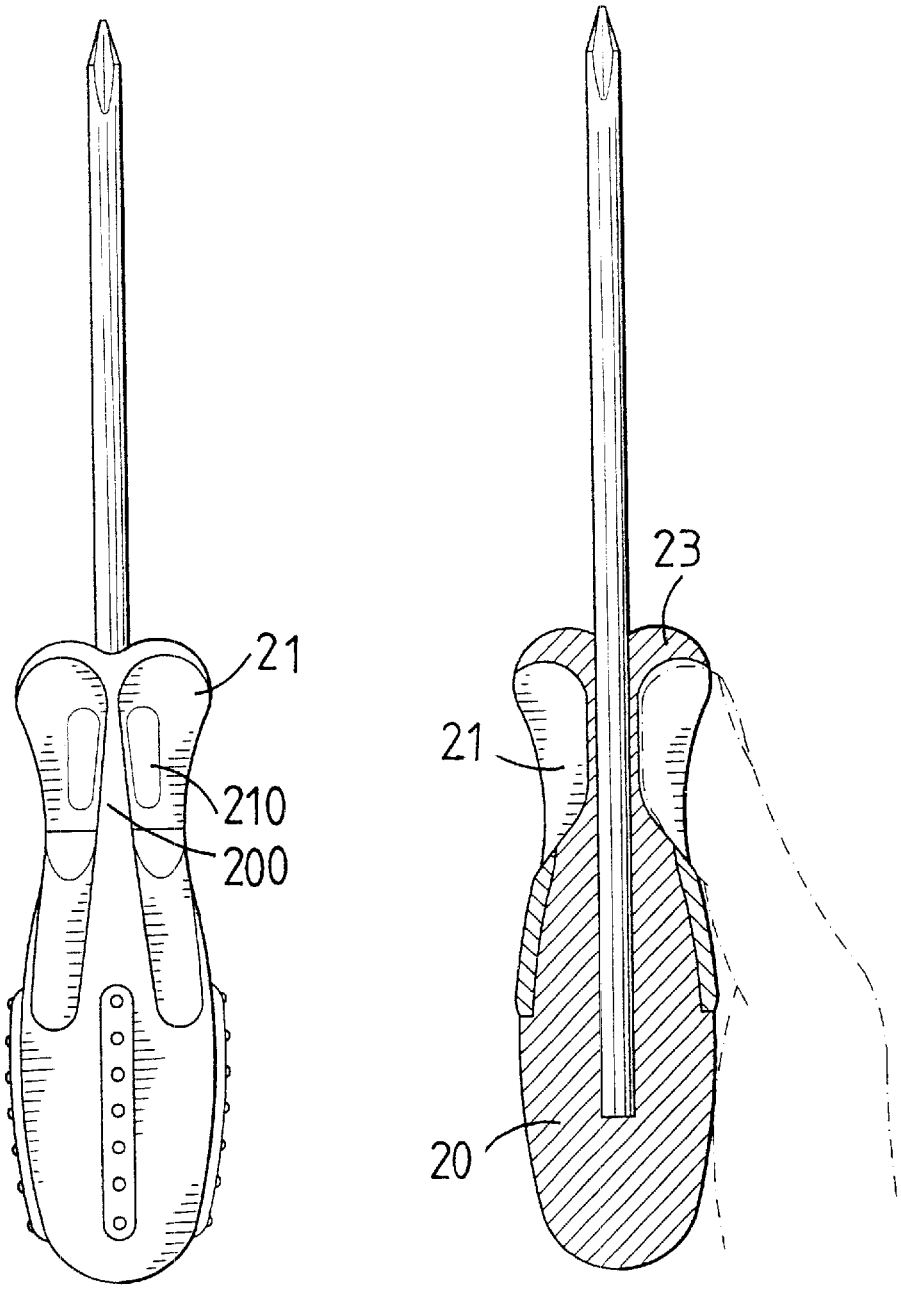
FIG. 3 shows the thumb of the user put in the recess of the handle of the present invention.
Figure 3:
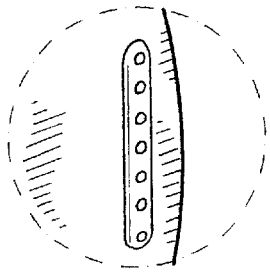
Figure 5:
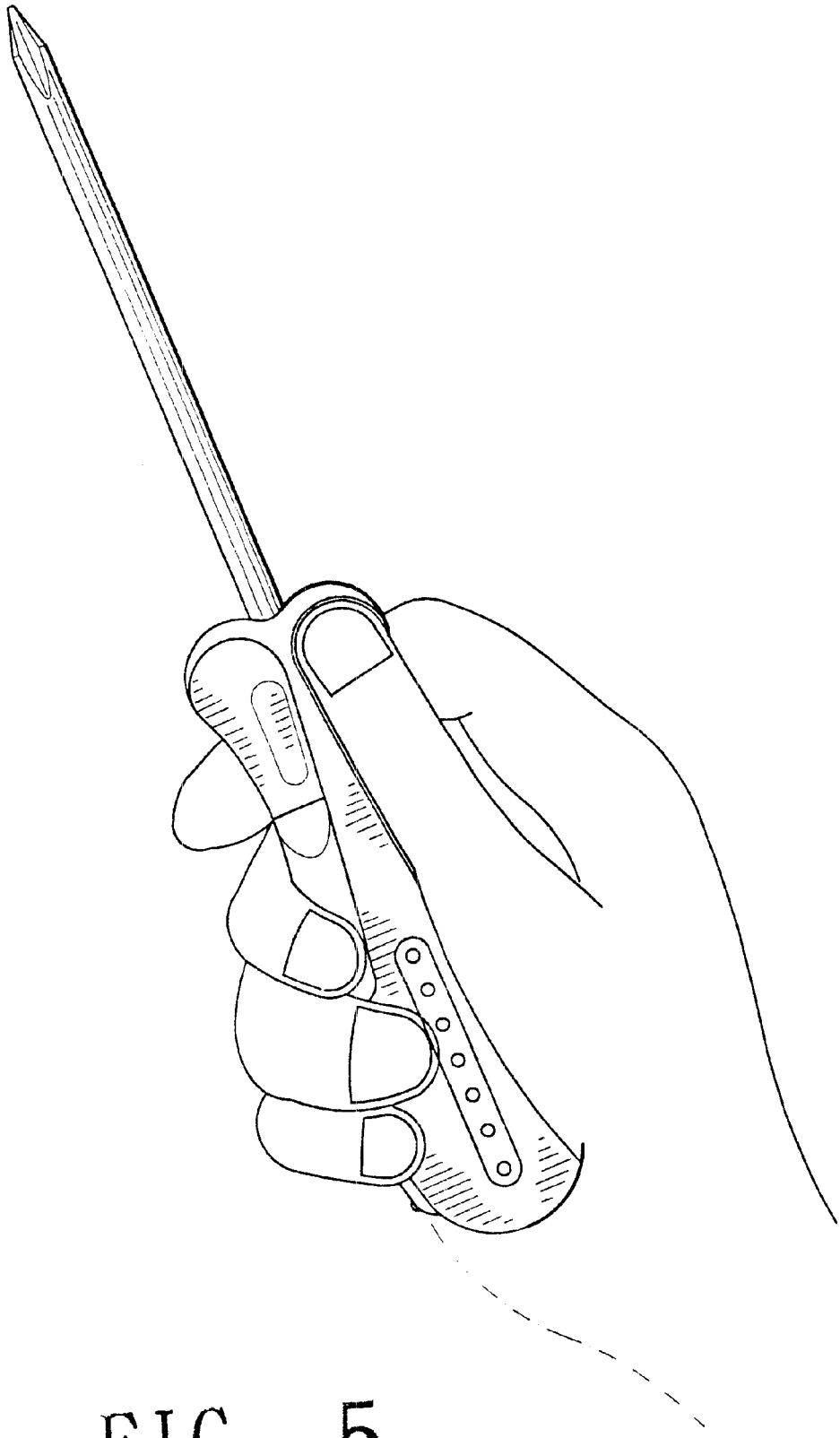
FIG. 5 shows the hand of the user holding the handle of the present invention.

Referring to FIGS. 2, 3 and 5, the hand tool of the present invention comprises a handle 20 and a shank extends from a first end of the handle 20. A plurality of recesses 21 are defined in an outer surface of the handle 20 and located close to the first end of the handle 20. A flat surface 210 is defined in an inner periphery of each recess. The recesses 21 are separated by longitudinal separation protrusions 200 between the recesses 21. A plurality of ridges 22 extend from an outside of the handle 20 and each ridge 20 has a plurality of bosses extending therefrom. Each of the ridges 22 is located on a common axis of the respective one of the separation protrusions 200, and the ridges 22 are located close to a second end of the handle 20.

When holding the handle 20, the thumb of the user's hand is placed in one of the recesses 21 and the thumb assists the rotation of the handle 20 to output a large torque.

Figure 4:
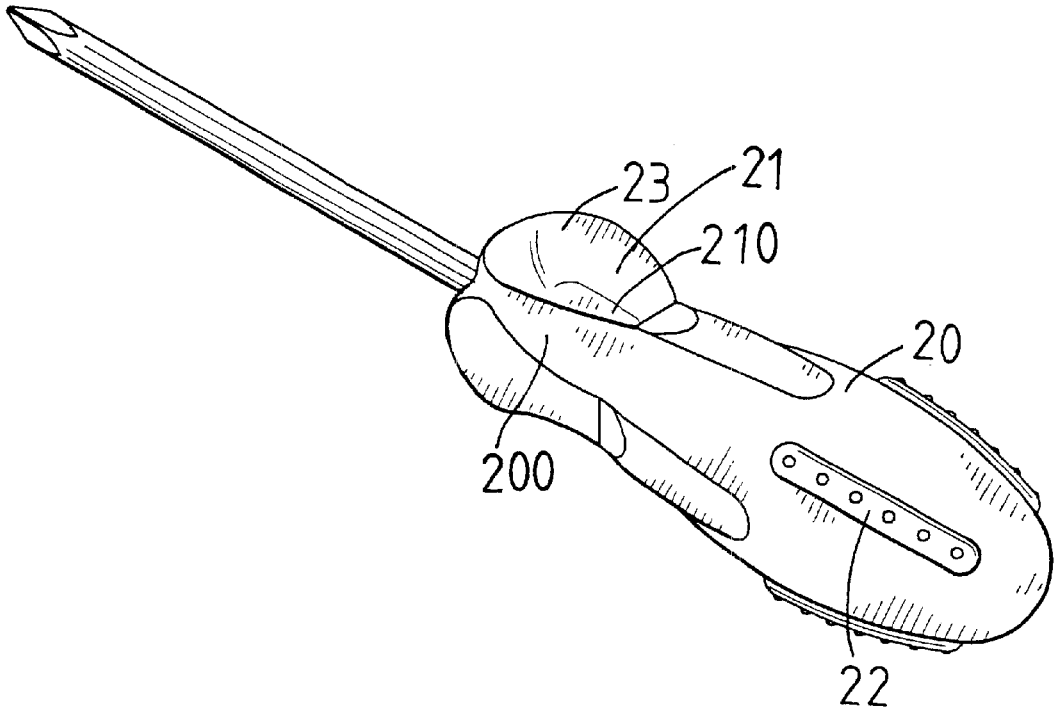
FIG. 4 is a perspective view to show that the recess of the handle of the present invention has an extension wall.

Referring to FIG. 4, an extension wall 23 extends from an inside of each of the recesses 21 and each recess 21 ends at respective extension walls 21. The extension walls 21 form the second end of the handle 20. An outer diameter of the extension walls 21 is not less than an outer diameter of the handle 20. This ensures that the thumb is enclosed by the inside of the recess 21 such that the thumb will not slip off from the recess 21 during operation.

While we have shown and described the embodiment in accordance with the present invention, it should be clear to those skilled in the art that further embodiments may be made without departing from the scope of the present invention.

What is claimed is:

1. A hand tool comprising:

a handle having a shank extending from a first end of the handle, a plurality of recesses defined in an outer surface of the handle and located close to the first end of the handle, the recesses being separated by longitudinal separation protrusions between the recesses, an extension wall extending from an inside of each of the recesses and each recess being ended at the respective extension walls, the extension walls forming the first end of the handle, an outer diameter of the extension walls being not less than an outer diameter of the handle.

2. The hand tool as claimed in claim 1, wherein a plurality of ridges extend from an outside of the handle and each of the ridges is located on a common axis of the respective one of the separation protrusions, the ridges located close to the second end of the handle.

3. The hand tool as claimed in claim 2, wherein each ridge has a plurality of bosses extending therefrom.

4. The hand tool as claimed in claim 1 further comprising a flat surface defined in an inner periphery of each recess.

* * * * *